US006793526B1

(12) United States Patent
Hsu et al.

(10) Patent No.: US 6,793,526 B1
(45) Date of Patent: Sep. 21, 2004

(54) STACKED CONNECTOR

(75) Inventors: Chang-Hsin Hsu, Taipei Hsien (TW); Hai-Dong Wu, TungKuan (CN); Ding-Cheng Gong, TungKuan (CN)

(73) Assignee: Wieson Technologies Co., Ltd., Taipei Hsien (TW)

( * ) Notice: Subject to any disclaimer, the term of this patent is extended or adjusted under 35 U.S.C. 154(b) by 0 days.

(21) Appl. No.: 10/465,228

(22) Filed: Jun. 20, 2003

(51) Int. Cl.[7] ..... H01R 13/66
(52) U.S. Cl. ..... 439/541.5; 439/607
(58) Field of Search ..... 439/541.5, 607–610, 439/79, 76.1, 540.1, 676, 488–490

(56) References Cited

U.S. PATENT DOCUMENTS 6,183,292 B1 * 2/2001 Chen et al. ..... 439/541.5
6,319,051 B1 * 11/2001 Chang et al. ..... 439/490
6,375,496 B1 * 4/2002 Casey et al. ..... 439/541.5
6,478,610 B1 * 11/2002 Zhou et al. ..... 439/490
6,600,865 B2 * 7/2003 Hwang ..... 385/134

* cited by examiner

*Primary Examiner*—P. Austin Bradley
*Assistant Examiner*—Edwin A. Leon
(74) *Attorney, Agent, or Firm*—Rosenberg, Klein & Lee

(57) ABSTRACT

A stacked connector includes a base dock connecting to an electric circuit. The base dock has an insert member mounted thereon. The insert member includes at least two insert slots and is encased by a metal shell from outside. The rear side of the insert member is coupled with a transfer connection circuit. The base dock has connection terminals directly connecting to the electric circuit. The connection terminals in each insert slot are extended to the rear side of the insert member to connect to the transfer connection circuit. Thereby the length of the connection terminals may be reduced to lower the cost and enhance the structural sturdiness and reduce interference between the terminals.

6 Claims, 8 Drawing Sheets

STACKED CONNECTOR

BACKGROUND OF THE INVENTION

1. Field of the Invention

The present invention relates to a stacked connector that has a shrunk length for connection terminals at each layer, enhanced total structural strength and reduced interference between the terminals.

2. Description of the Prior Art

Electric devices generally have connectors coupled on the circuits to facilitate insertion and removal of other peripheral devices and link electric circuits. In addition, as memory cards and other external connecting devices have many different specifications, the electric circuits also require connectors that have various types of slots to couple with the corresponding memory cards or external connecting devices.

Therefore there are many different types of connectors being developed to provide stacking insert slot configurations (generally called stacked connectors). The stacking design enables the whole set of connectors to equip multiple functions. In addition, it also can shrink the area of electric circuits in the connector to make overall electric circuit configuration easier. However, conventional stacked connectors usually have the connection terminals of each slot extending respectively to the rear side of the connectors. The connection terminals are naked and bent to connect to the electric circuits. When the number and height of the stacking insert slots increases, the length of the connection terminals in each insert slot also increases. As a result, the connecting strength of the connection terminals decreases. Moreover, the naked portions of the connection terminals do not have protecting shield, interference occurs.

SUMMARY OF THE INVENTION

Therefore the primary object of the present invention is to resolve the aforesaid disadvantages. The stacked connector according to the invention mainly has a base dock to connect electric circuits. The base dock has an insert member mounted thereon. The insert member includes at least two insert slots. The insert member is covered by a metal shell from outside. A transfer connection circuit is fixedly located on the rear side of the insert member. The base dock further has connection terminals to directly connect to the electric circuits. The connection terminals located in each insert slot of the insert member is extended to the rear side of the insert member to connect to the transfer connection circuit. Thereby the length of the connection terminals may be reduced. Overall structural strength of the connectors also increases, and interference between the terminals may be reduced.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENT

Figure 1:
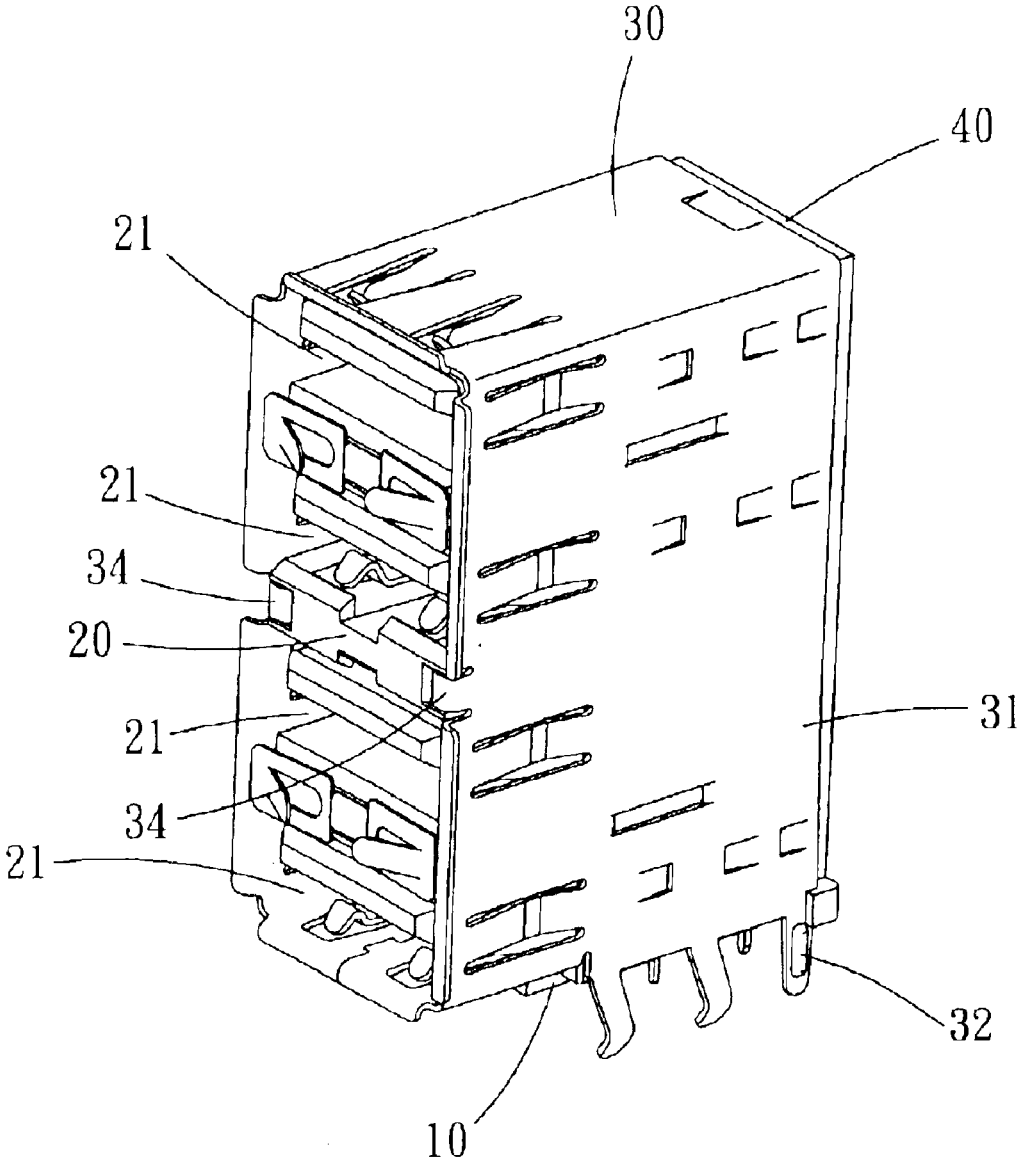
FIG. 1 is a front perspective view of the present invention.

Referring to FIG. 1, the stacked connector of the present invention mainly includes a base dock 10 and an insert member 20 mounted onto the base dock 10. The insert member 20 includes at least two insert slots 21. The insert member 20 is housed in a metal shell 30. There is a transfer connection circuit 40 located on a rear side of the insert member 20.

Figure 2:
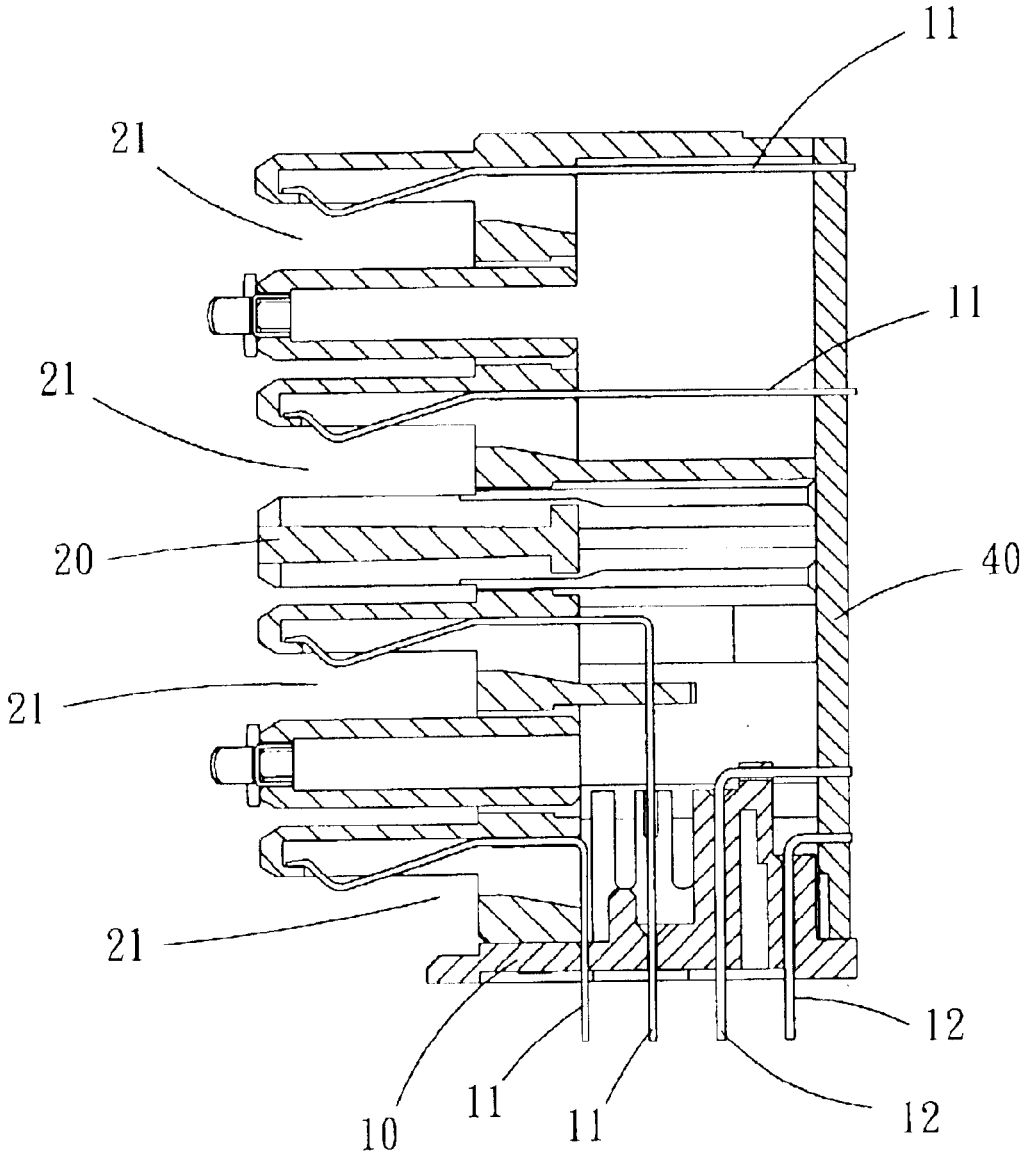
FIG. 2 is a sectional view of the present invention.

Referring to FIGS. 1 and 2, the base dock 10 has connection terminals 11 directly connecting to electric circuits. The connection terminals 11 located in the lowest insert slot 21 of the insert member 20 run through the base dock 10 to connect to the electric circuits. The connection terminals 11 in other insert slots 21 are extended to the rear side of the insert member 20 to connect to the transfer connection circuit 40. The transfer connection circuit 40 is extended to the base dock 10, then is connected to the electric circuits through a transfer terminal 12 located in the base dock 10. Thus the length of the connection terminals in each slot may be reduced, and the structural strength increases, and the interference between the naked portions of the connection terminals also decreases.

Figure 3:
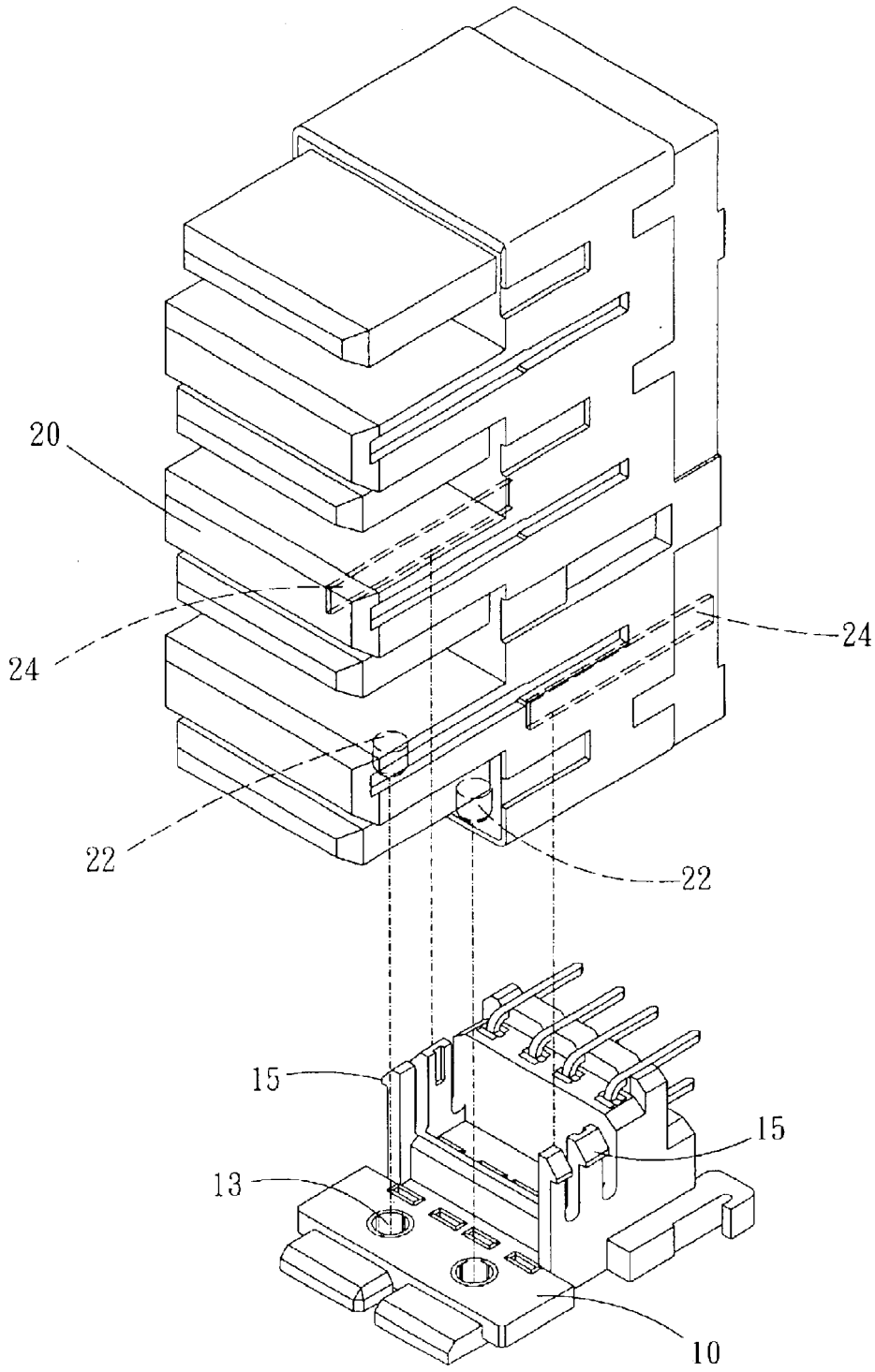
FIG. 3 is an exploded view of the base dock and insert member of the present invention.
Figure 4:
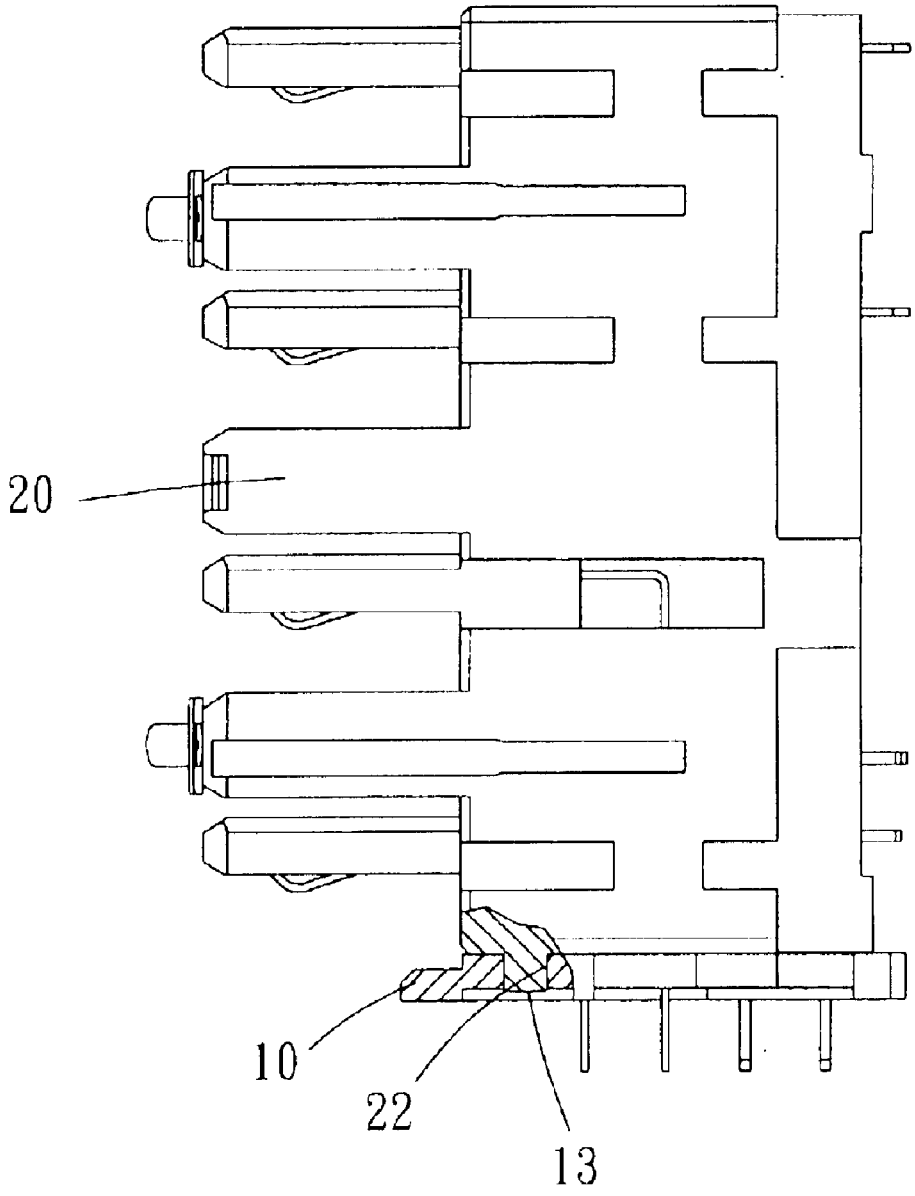
FIG. 4 is a sectional view of the insert strut and insert hole of the present invention.
Figure 5:
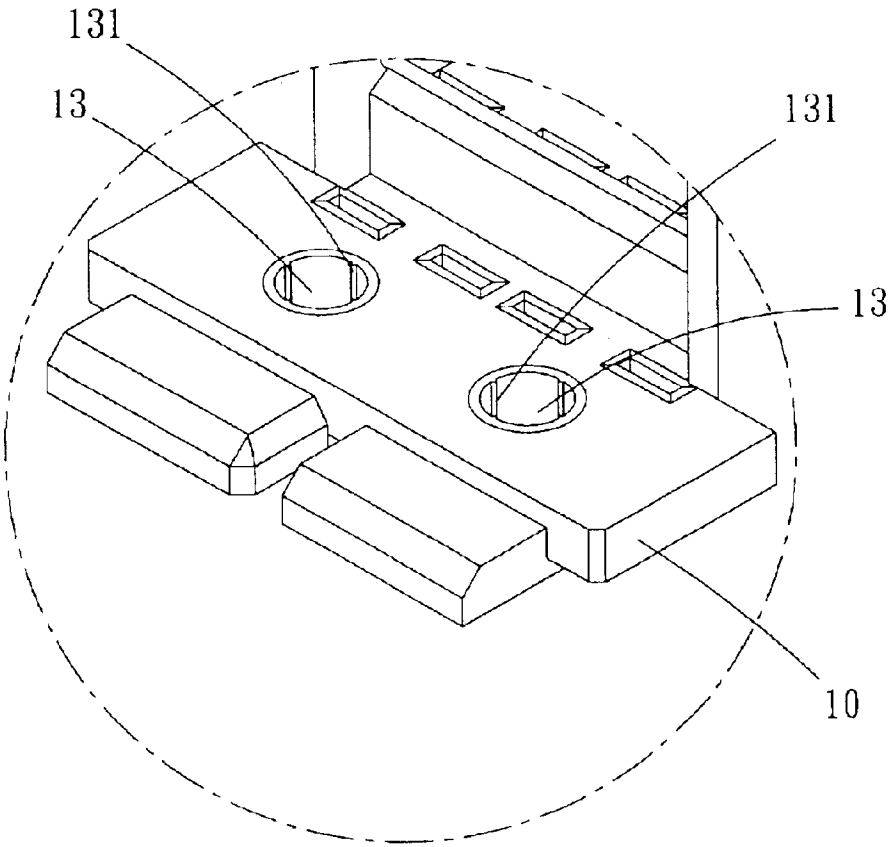
FIG. 5 is a fragmentary perspective view of the insert holes on the base dock of the present invention

Referring to FIGS. 3 and 4, the insert member 20 has insert struts 22 located on the bottom thereof to insert into insert holes 13 formed on the base dock 10 on the coupling surface therebetween so that the insert member 20 may be coupled with the base dock 10. The insert holes 13 have bulged traces 131 formed on the inner surface (as shown in FIG. 5) to increase the coupling effect between the insert strut 22 and the insert hole 13. The transfer connection circuit 40 is fastened to the base dock 10 and the insert member 20 (not shown in the drawings) through a fastener 50 as shown in FIG. 6.

Figure 6:
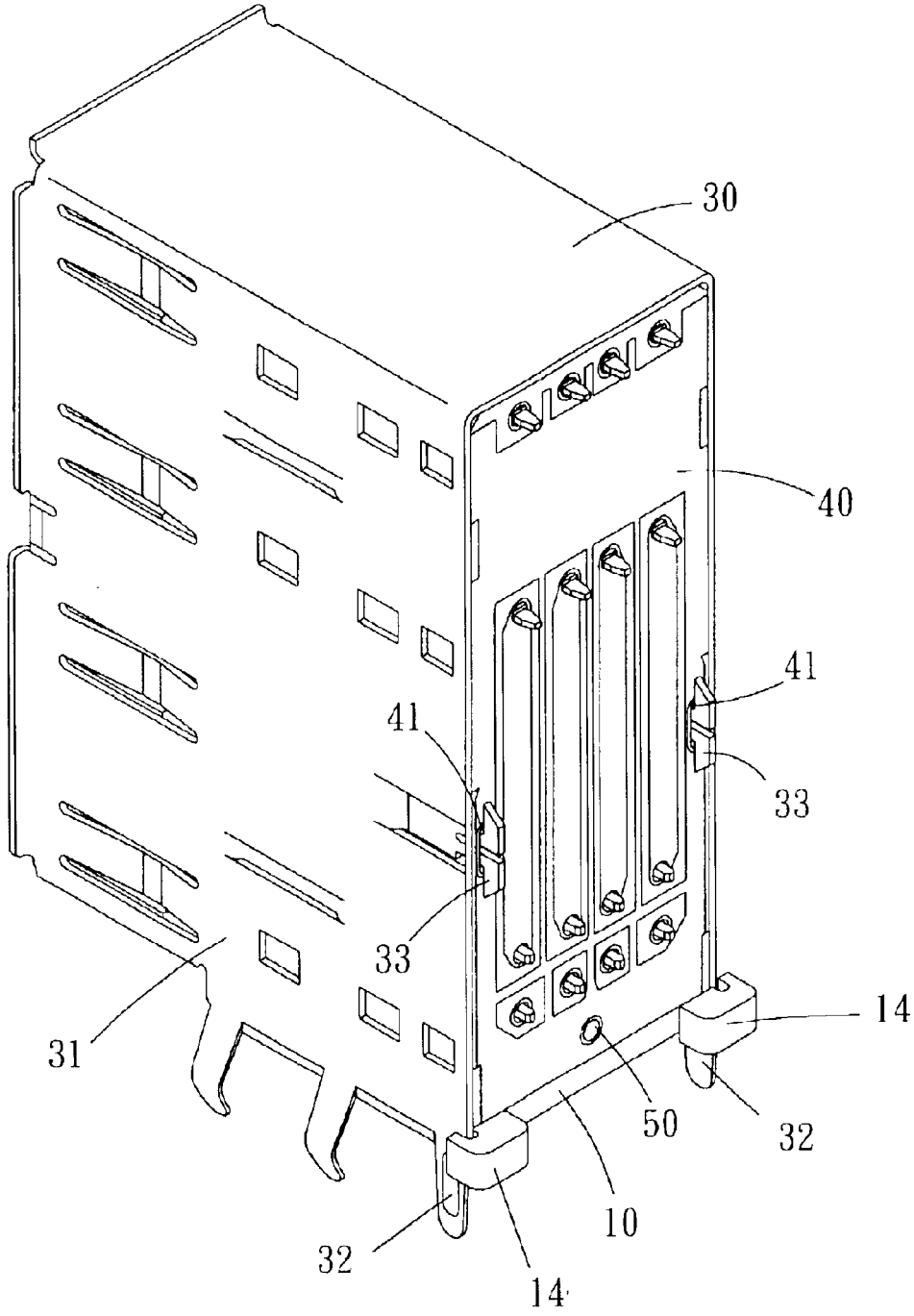
FIG. 6 is a perspective view of the shell and transfer connection circuit of the present invention coupling together.

Referring to FIGS. 1 and 6, the shell 30 encasing the insert member 20 from outside is made of metal. The shell 30 has two side walls 31 to couple with the base dock 10. The two side walls also are extended to form jutting ledges 32 in contact with the lateral sides of the base dock 10. The jutting ledges 32 further are extended to connect to the electric circuits to increase the sturdiness of the shell 30. They further can be wedged in latch ears 14 located on the base dock 10 to prevent the side walls 31 of the shell 30 from moving away.

Figure 7:
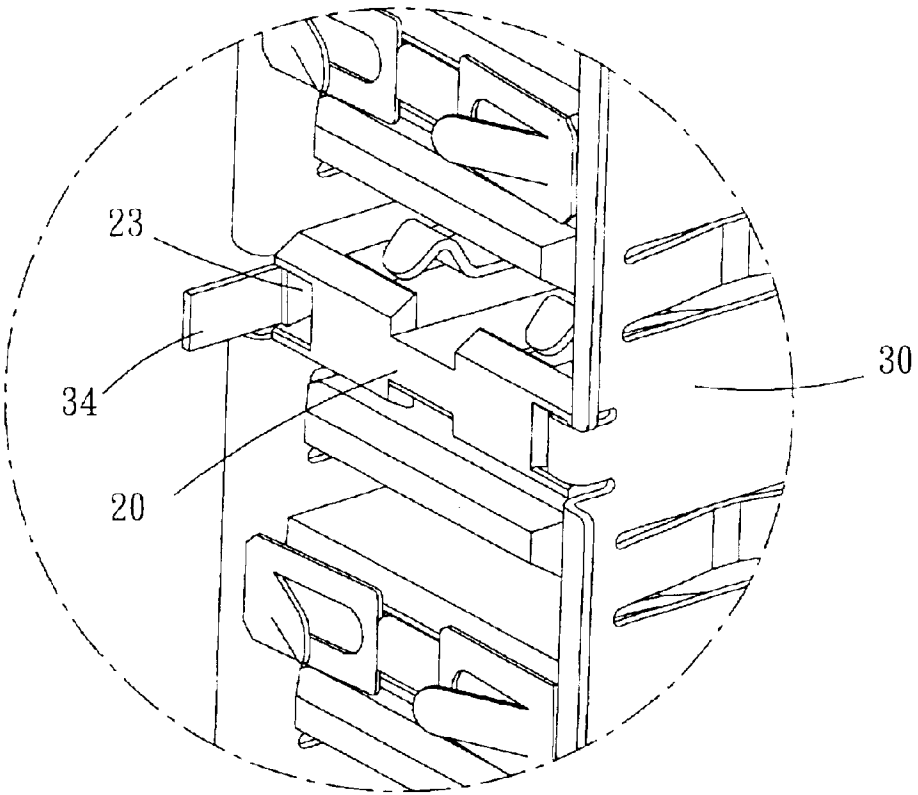
FIG. 7 is a fragmentary perspective view of the shell and the insert member of the present invention in a coupling condition.

Referring to FIG. 6, the transfer connection circuit 40 and the side walls 31 of the shell 30 have respectively latch slots 41 and hooks 33 located on the juncture thereof. The hooks 33 of the side walls 31 may run through the latch slots 41 to couple with the transfer connection circuit 40. Referring to FIGS. 1 and 7, the side walls 31 of the shell 30 further has latch hooks 34 corresponding to the front side of the insert member 20. The latch hooks 34 may be bent inwards to latch on a latch trough 23 formed on the latch member 20 to enable the shell 30 to couple with the insert member 20.

Thus the shell 30 and the insert member 20 and the transfer connection circuit 40 may form a secured fastening.

Figure 8:
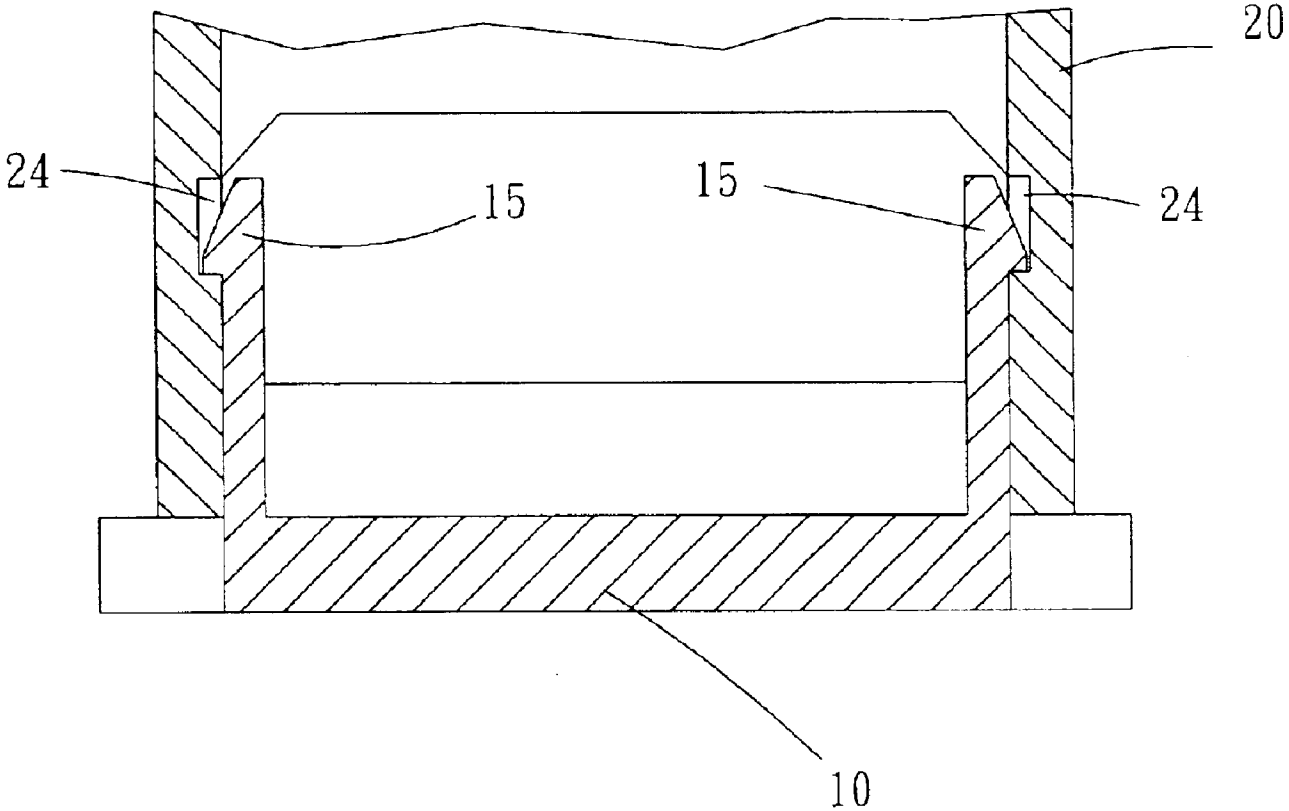
FIG. 8 is a fragmentary cross section of the present invention showing the base dock coupling with the insert member.

In addition, referring to FIGS. 3 and 8, besides having insert holes 13 on the base dock 10 and insert struts 22 on the insert member 20 for coupling with each other, the base dock 10 further has hook plates 15 formed on the coupling surface of the base dock 10 and the insert member 20 that are extended toward the insert member 20. And the insert member 20 has recesses 24 formed on the inner walls corresponding to and engaging with the hook plates 15 to further enhance the total structural strength of the connector.

While the preferred embodiment of the present invention has been set forth for the purpose of disclosure, modifications of the disclosed embodiment of the present invention as well as other embodiments thereof may occur to those skilled in the art. Accordingly, the appended claims are intended to cover all embodiments which do not depart from the spirit and scope of the present invention.

What is claimed is:

1. A stacked connector, comprising:

a base dock fastened to an electric circuit;

an insert member mounted onto the base dock having at least two insert slots, each insert slot having connection terminals, the insert member having insert struts formed on a bottom thereof, the base dock having insert holes formed on a coupling surface between the insert member, the insert struts being insertable into the insert holes to couple the insert member with the base dock, the insert holes having bulged traces formed on an inner wall thereof to increase a coupling effect with the insert struts; and a transfer connection circuit fixedly located on a rear side of the insert member connecting to the electric circuit;

wherein the connection terminals in the insert slot located on the lowest layer run through the base dock to connect to the electric circuit, the connection terminals in other insert slots are extended to the rear side of the insert member to connect to the transfer connection circuit, the transfer connection circuit being extended to the base dock to connect to the electric circuit through a transfer connection terminal located in the base dock thereby to reduce the length of the connection terminals, enhance the structural sturdiness of the connector and reduce the interference between the terminals.

2. A stacked connector, comprising:

a base dock fastened to an electric circuit:

an insert member mounted onto the base dock having at least two insert slots, each insert slot having connection terminals, the insert member being encased by a metal shell from outside, the shell having two side walls to couple with the base dock, the side walls being extended to form jutting ledges in contact with lateral sides of the base dock, the base dock having latch ears corresponding to the jutting ledges for clipping the jutting ledges; and a transfer connection circuit fixedly located on a rear side of the insert member connecting to the electric circuit;

wherein the connection terminals in the insert slot located on the lowest layer run through the base dock to connect to the electric circuit, the connection terminals in other insert slots are extended to the rear side of the insert member to connect to the transfer connection circuit, the transfer connection circuit being extended to the base dock to connect to the electric circuit through a transfer connection terminal located in the base dock thereby to reduce the length of the connection terminals, enhance the structural sturdiness of the connector and reduce the interference between the terminals.

3. The stacked connector of claim 2, wherein the side walls of the shell have latch hooks corresponding to the front side of the insert member and being bent and extended inwards to latch on a latch trough formed on the insert member tol allow the shell to couple with the insert member.

4. The stacked connector of claim 2, wherein the transfer connection circuit and the side walls of the shell have respectively latch slots and hooks corresponding to and engageable with each other for coupling the transfer connection circuit and the shell.

5. The stacked connector of claim 2, wherein the jutting ledges of the shell are extended to connect to the electric circuit.

6. A stacked connector, comprising:

a base dock fastened to an electric circuit;

an insert member mounted onto the base dock having at least two insert slots, each insert slot having connection terminals, the base dock having hook plates located on a coupling surface with the insert member and extended toward the insert member, the insert member having recesses formed on inner walls corresponding to and engageable with the hook plates to enhance the structural strength of the entire connector; and a transfer connection circuit fixedly located on a rear side of the insert member connecting to the electric circuit;

wherein the connection terminals in the insert slot located on the lowest layer run through the base dock to connect to the electric circuit, the connection terminals in other insert slots are extended to the rear side of the insert member to connect to the transfer connection circuit, the transfer connection circuit being extended to the base dock to connect to the electric circuit through a transfer connection terminal located in the base dock thereby to reduce the length of the connection terminals, enhance the structural sturdiness of the connector and reduce the interference between the terminals.

* * * * *